United States Patent [19]

Lapeyre

[11] Patent Number: 4,727,935

[45] Date of Patent: Mar. 1, 1988

[54] HEAT EXCHANGER AND METHOD FOR MAKING SAME

[75] Inventor: James M. Lapeyre, Orleans Parish, La.

[73] Assignee: Laitram Corporation, New Orleans, La.

[21] Appl. No.: 733,205

[22] Filed: May 13, 1985

[51] Int. Cl.[4] ..... B22C 13/14

[52] U.S. Cl. ..... 165/163; 29/157.3 R; 165/165

[58] Field of Search ..... 165/133, 163, 165

[56] References Cited

U.S. PATENT DOCUMENTS 2,519,084 8/1950 Tull ..... 165/163 X 3,053,511 9/1962 Godfrey ..... 165/133

*Primary Examiner*—Allen M. Ostrager

*Attorney, Agent, or Firm*—Keaty & Keaty

[57] ABSTRACT

An improved heat exchanger is shown for indirect heat exchange between two fluid media. The heat exchanger has thin metallic walls and a multitude of convoluted shaped internal flow passages, increasing the effective contact time during which heat is transferred between the media. The heat exchanger is particularly suitable for heat exchange between fluids having low differential temperatures or specific heats, due to the thin wall structure, the elongated internal flow path created by the convoluted core structure and the absence of welds, soldering, or other thick areas which tend to inhibit heat transfer due to their relatively greater mass. The heat exchanger may be produced by a novel technique. A support matrix is assembled from a plurality of low melting point forms, each of which has angled internal passages. The passages of each form are positioned in register with the passages of adjacent forms. The entire assembly is then clamped together to establish a conductive matrix having the desired internal flow paths. The clamped assemblage is then subjected to a metal reposition technique forming a thin metallic coat, and thus creating the desired heat exchanger structure. The treated assemblage is then heated, melting the internal core matrix, removing it from the deposited surface, leaving the desired thin wall heat exchanger structure.

6 Claims, 8 Drawing Figures

HEAT EXCHANGER AND METHOD FOR MAKING SAME

BACKGROUND OF THE INVENTION

It is known within the field of indirect heat exchangers that the transfer of heat from a first to a second heat exchanging fluid is a combined function of the relative masses, differential temperature, and specific heats of the two fluids in comparison to the thickness and mass of the intervening heat exchange structure which separates the two fluids.

When the fluids within a heat exchanger are of relatively low specific heat or differential temperature, the efficiency of the heat exchanger of the indirect type is often adversely affected by the thickness of the heat exchange walls. Minimum wall thickness is established by manufacturing requirements necessary to obtain a realizable heat exchanger. In compensation for resulting resistance to heat flow, various techniques have been used to lengthen the flow path and the flow time for both fluids in the heat exchanger so as to provide maximal heating transfer. Thus an indirect heat exchanger is often seen to include many elongated fins, zig-zags, or other difficult to manufacture impediments to fluid flow, all of which are intended to lengthen the contact time of the fluid with the heat exchanger and thus increase the heat transfer per unit of fluid passed.

The most common method of forming such heat exchangers is by soldering or welding together multiple, corrugated, thin wall metallic structures. Since the structure must be fluid tight, manufacturing tolerances are extremely critical, and extensive effort is required to insure that leak tight soldered joints or welded structures have been formed. In addition, the resulting structure, for low specific heat fluids, can become extremely large and expensive to manufacture.

More recently, certain heat exchange structures, especially within the area of rocket engines, have been developed by the process of forming one wall of the heat exchanger structure, casting or attaching a meltable material to that wall, carving the meltable material so as to create a desired surface of a second wall of the heat exchange structure, electroforming a second wall upon the substrate, and then removing the substrate by melting. While this process eliminates many soldering and welding steps, and thus decreases one particular failure area, it requires individual, often manual, one time creation to form the substrate, since the defining substrate is destroyed in the process of creating the final product. It requires the formation of a first heat exchanger wall as a separate task. This technique is thus seen primarily in low production rate, high precision products such as rocket engine combustor thrust nozzles.

SUMMARY OF THE INVENTION

This invention discloses a novel heat exchanger, particularly suitable for use in an indirect heat exchange, which is formed by forming a thin layer by electroforming, chemical deposition techniques and the like around an easily manufactured material pattern assembly. The invention is capable of forming structures which are impossible of realization by prior art techniques.

It is particularly desirable within a heat exchanger that a convoluted or elongate flowpath be provided for the fluids through the heat exchanger. The instant invention provides such a flow path by providing a multitude of individual flow channels for a first fluid to the heat exchanger, constructing these flow channels in a convoluted form so as to maximize the flow distance within given external size constraints on the heat exchanger. Likewise, by eliminating all metal deforming operations, such as bending, and melting, such as soldering and brazing, this invention enables the heat exchanger to be built with a thinner wall structure than would otherwise be possible.

The structure thus formed comprises an essentially closed chamber formed of a thin deposited wall for enclosing a first heat exchange fluid. Penetrating through the chamber between opposite side walls are a plurality of convoluted flow passages, also deposited, for a second fluid. The combination of the thin walls and the convoluted flow passages provides exceptionally efficient transfer of heat between the two fluids.

One example of this heat exchanger is formed by a novel method in which a series of identical rectangular substrate plates are formed of a low melting point metal or other low melting point electrically conductive substance. A regular pattern of angled holes is then formed within the plates either by boring or by casting the plates within a die. The plates are clamped into a stack, alternating every other plate so that the regular pattern of holes line up, forming an internal zig-zag shape. The stack, or matrix, is then electroplated to a uniform thickness with a chosen metal or metals. The plated matrix is then heated, melting out the matrix material, leaving a formed heat exchanger, having uniform wall thickness and a desired pattern of internal flow channels.

An alternate embodiment, not requiring a conductive matrix, forms a matrix of a low melting point material and then, by chemical or vapor deposition, creates the wall structure. The matrix is then likewise removed by melting.

It is thus an object of this invention to provide a heat exchanger especially suited for low heat resistance in indirect heat exchange.

It is a further object of this invention to provide a heat exchanger having a uniform, thin, metallic wall structure.

It is further an object of this invention to provide a heat exchanger having a convoluted internal flow passageway, utilizing neither welding nor soldering construction techniques.

It is a further object of this inventin to provide a heat exchanger having a complex internal structure utilizing a simplified, mass production capable production technique.

It is a further object of this invention to provide a method of manufacturing a heat exchanger which eliminates the necessity for welding, brazing, soldering, or similar metal joining operations.

It is a further object of this invention to provide a method for manufacturing a heat exchanger which is capable of producing thinner heat exchanger walls than may be created by mechanical forming.

MATERIAL INFORMATION DISCLOSURE

Butter, et al U.S. Pat. No. 3,738,916 discloses a method for manufacturing an internal nozzle assembly for regeneratively cooled rocket combustion chambers in which an existing galvanic core having a negative form of the rocket nozzle throat with cooling channels receives a primary galvanic layer. The cooling channels are filled with a meltable conducting fill material. An electroformed metal coat is galvanically deposited upon the conductive material, forming the inner wall of the rocket nozzle, and the clad material is melted out.

Hambling, et al U.S. Pat. Nos. 3,959,109 and 4,043,876 disclose a method of forming a metallic structure within an electroplating bath in which a mold former is continuously rotated within the bath with respect to a plating anode. The mold must then be mechanically removed from the electroformed cylinder structure.

Shimada, et al U.S. Pat. No. 3,853,714 disclose a method of forming hollow components by an electroplating process in which a mold containing a cavity having the shape of the exterior of the hollow component is provided. The mold is coated with a conductive material, and is then used as the cathode within a standard electroforming process, to electroplate a layer of metal upon the interior of the mold. The component is then mechanically removed, by opening the mold.

Gowan, et al U.S. Pat. No. 4,387,962 discloses an existing heat exchanger structure in which the internal passages of the heat exchanger are coated with a corrosion resistant material to withstand the chemical effects of one of the cooling fluids.

Trott, U.S. Pat. No. 4,243,495 is cited to show alternate structures which are capable of being made by electroforming, in this case, continuous sheets of metal.

DETAILED DESCRIPTION OF THE PREFERRED EMBODIMENT

Figure 1:
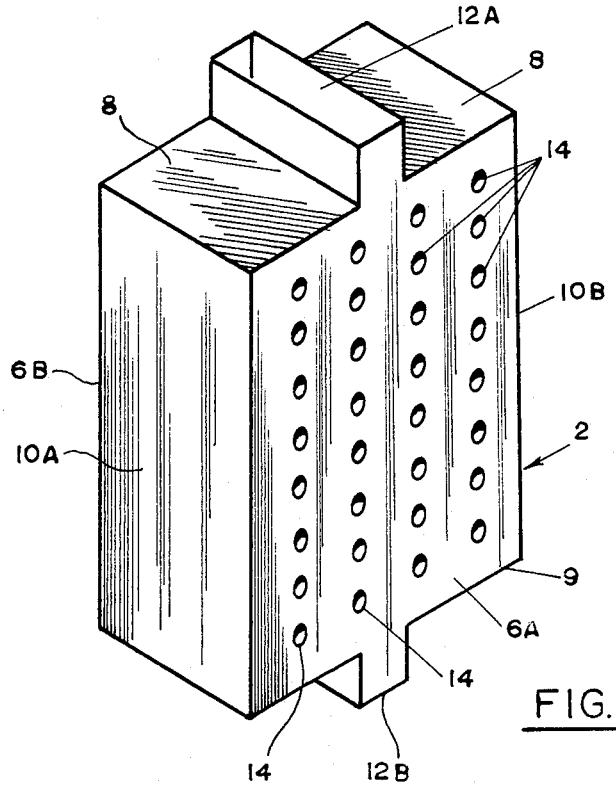
FIG. 1 is an angled, perspective view of the heat exchanger incorporating the features of this invention.
Figure 2:
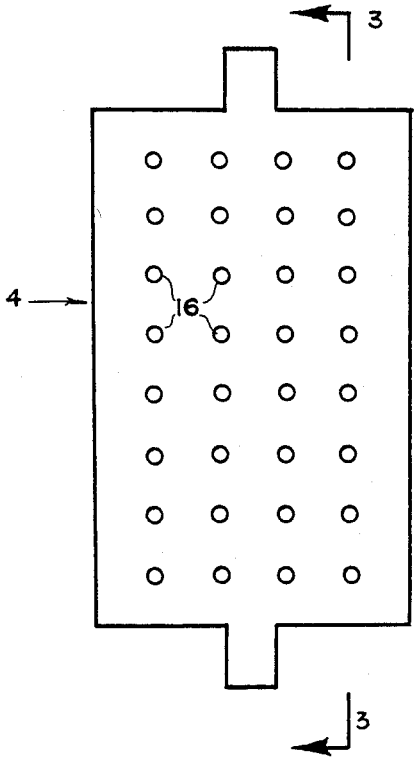
FIG. 2 shows a front view of a meltable pattern form used as a component of the matrix upon which the heat exchanger is formed according to the process of the invention.
Figure 3:
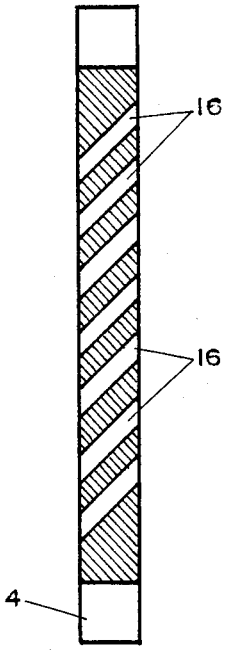
FIG. 3 is a side section view of a single meltable pattern form from which the core matrix is assembled.

FIG. 1 shows in perspective view the heat exchanger 2 of the current invention. The heat exchanger 2 is seen to comprise a closed vessel or chamber which has two faces 6A and 6B, an upper or top end surface 8 and a bottom end surface 9 and two sidewalls 10A and 10B, which together describe the six walls of a rectilinear volume.

The six enclosed walls define an interior rectilinear chamber, and is illustrated therefore as an exterior of generally rectangular form. The structure as described is a preferred embodiment, which is shown to illustrate a particular example of the overall method of the current inention, together with the resulting heat exchanger 2 from the method. It should be apparent, however, that the described method is capable of forming a wider range of heat exchanger shapes than here shown, and the particular form shown here of the heat exchanger 2 is chosen for purposes of clarity illustrating the invention and the method thereof.

In the specific example of the heat exchanger 2 shown herein, the interior chamber formed by the six sides: the faces 6A and 6B; the end walls 10A and 10B; and the uppr and lower faces 8 and 9, form an interior enclosed rectangular chamber. Flow access is gained to the interior of the heat exchanger 2 through provided flow entrances 12A and 12B; flow entrance 12A being an opening intermediate top face 8, and flow exit 12B being intermediate bottom face 9. It should be obvious that any one of the core sections 4 (FIG. 4) is of a thickness equivalent to a fraction of the thickness between faces 6 and of a height and a width equivalent to the distance between end edges 8 and 9 and the distance between sides 10*a* and 10*b*, respectively. Within each core section 4, located corresponding to the regular array of the convoluted passages 14 of heat exchanger 2, are found a pattern of angled passages 16.

Figure 6:
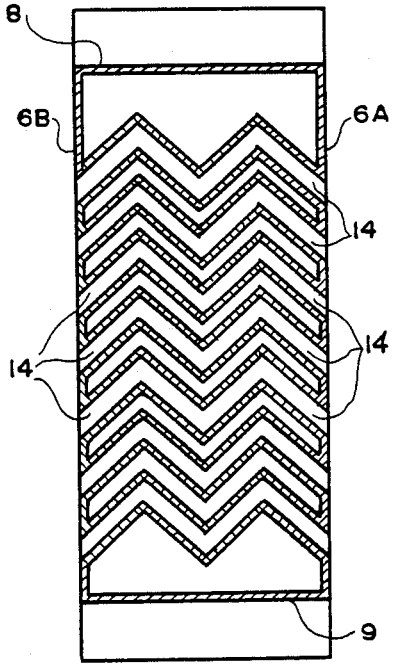
FIG. 6 is a section showing the electroformed heat exchanger of FIG. 5.

A plurality of said core sections 4 clamped together with every other section 4 being inverted with respect to the direction of its angled passages 16, forms a solid unit creating the pattern of the convoluted passages 14 as shown in the construction of the heat exchanger 2 in FIG. 6.

Each of the core sections 4 is constructed of a low melting point material having, in one preferred embodiment, electrical conductivity. This may be one of the known typesetters metals such as Babbit Metal or alternatively, may be a wax. The array of core sections 4 is utilized to construct the heat exchanger 2 as hereinafter described.

Figure 4:
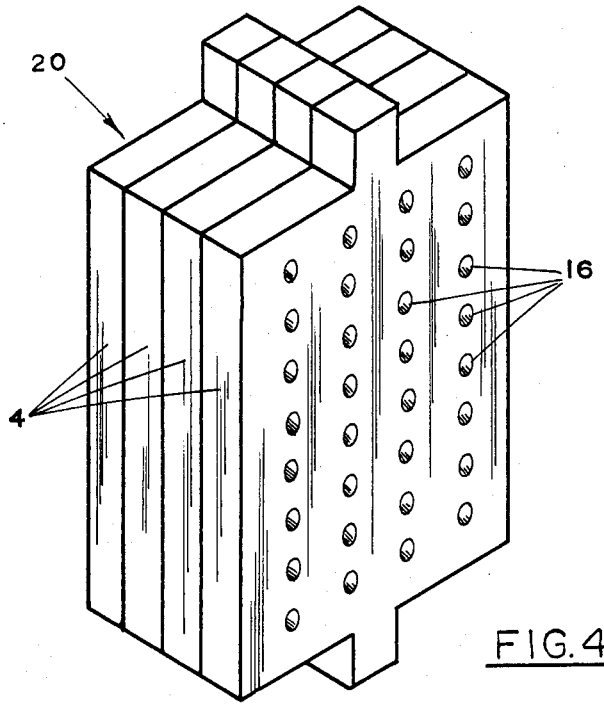
FIG. 4 is an angled perspective view, corresponding to FIG. 1, showing the meltable core matrix assembled from a plurality of pattern forms.
Figure 7:
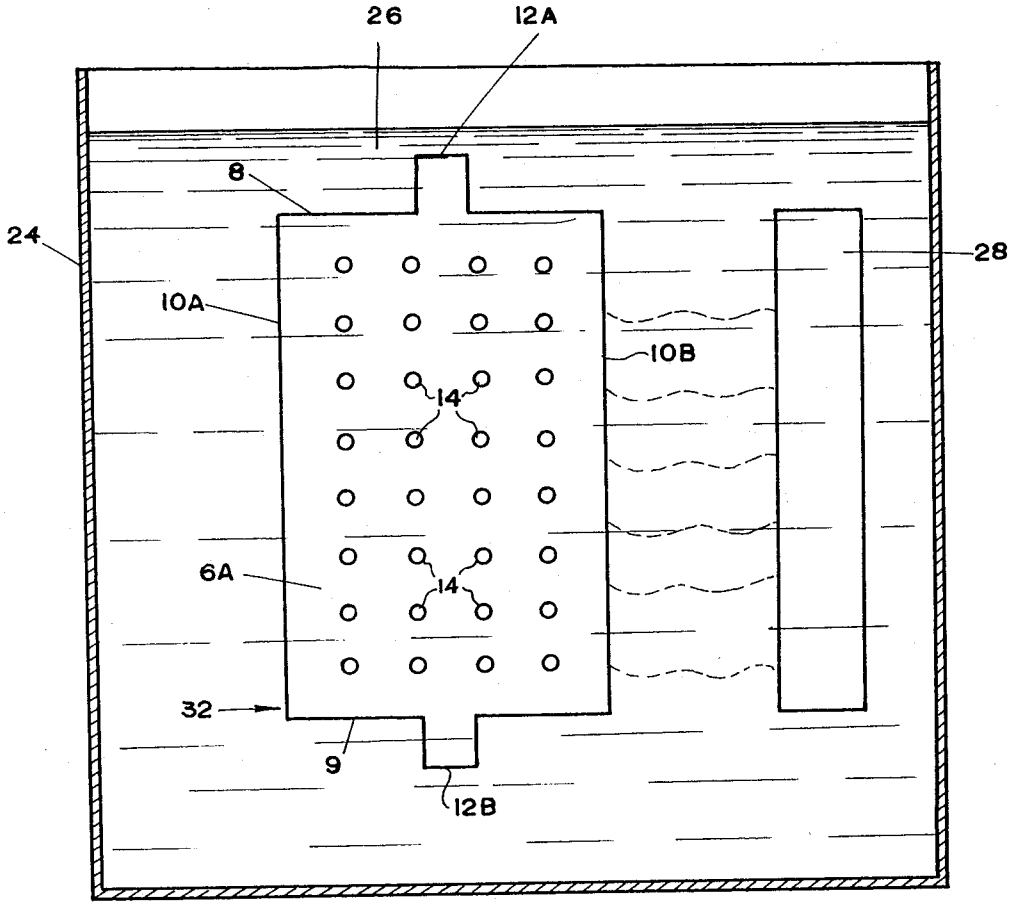
FIG. 7 is a side view of the electroforming process of the current invention.

In operation, the construction of the heat exchanger 2 is accomplished by assembling a plurality of core sections 4 to form the internal convoluted passages 16 as shown in FIG. 4. This assembled array of cores or matrix 20 is then placed within a forming apparatus 24 (FIG. 7) where the assembled cores or matrix 20 are immersed in a coating environment, such as electrolyte solution 26 within the apparatus 24.

If the coating is to be formed by plating, the matrix 20 is connected as a cathode to an electrical plating supply, not shown. A plating anode 28 of a chosen metal conformable with the chemical composition of a chosen electrolyte solution 26 is immersed in the electrolyte solution 26, connected also to the electroforming apparatus 24's power supply, not shown.

Alternately, solution 26 may be chosen so as to chemically deposit a coating upon core 20 by any of the chemical plating techniques known to the art.

As a third embodiment, apparatus 24 is sealed and evacuated, environment 26 being a vacuum. A chosen coating material 28 is then connected to a heating source, not shown, and, by vaporization or sputtering, caused to coat the matrix 20 with a uniform coating.

The core array 20 is thus plated or coated, forming a uniform extremely thin coat of a chosen metallic composition, which may be, as desired, either a single metallic composition or a plurality of layers of different metals, all as desired for the chemical composition and properties of the heat exchanger 2. Precious metals, providing corrosion resistance; nickel for strength of the overall structure; or copper, alone or in combination, may be chosen. Vapor deposition techniques would permit coatings of aluminum or silicon to be readily created.

Control of the plating process is well understood in the art and a uniform, controlled thickness of cladding can readily be deposited upon the array 20 of cores 4 including within the angled convoluted passageways 16.

Figure 5:
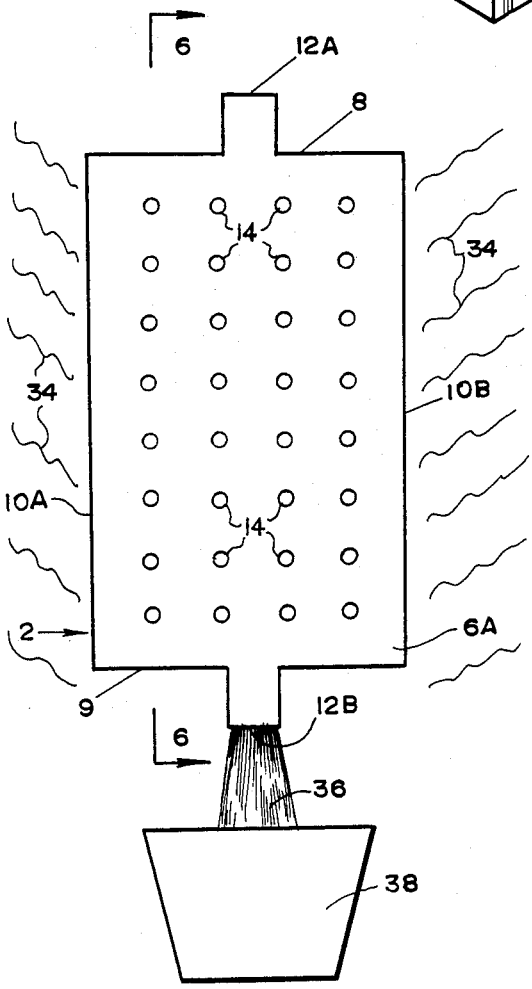
FIG. 5 shows the core removing process according to the method of the current invention.

The plated core 32 is then removed as is shown in FIG. 5. Heat 34, being preferably in the form of radiant heat, is applied to the plated array 20 of cores 4, raising the plated array 20 of cores 4 above the melting point of the material forming the core sections 4. The melted core material 36 flows from the lower of the flow entrances (12B) into a provided capture means 38 which may be used to recirculate the core material to an automated core forming apparatus.

It can be seen that extremely thin wall structures of great uniformity may be created. The combination of the thin metallic walls, the ease of obtaining lack of porosity in the structure due to a lack of the necessity for any metal joining during the construction of the heat exchanger 2, and the complex or convoluted internal flow structure exemplified by the convoluted flow passages 14 which may be readily created within this structure, creates a small heat exchanger of unique capabilities and characteristics. As can be seen in FIGS. 1 and 6 and as can be appreciated from the description herein, the method of the present invention produces a heat exchanger formed as a seamless shell.

In use, the heat exchanger 2 would be interconnected to a first media by connecting a supply (not shown) to the flow entrances 12*a* and 12B. A second media would be caused to flow from one face 6*a* through the convoluted flow passages 14 to a second face 6B in a connecting manner well understood in the art of heat exchangers. The entire structure interposes a considerably thinner metallic layer between the two media than has heretofore been realizable in the construction of heat exchangers having the requisite mechanical integrity and corrosion resistance. Thus the particular heat exchanger disclosed has a significantly reduced thermal resistance and is a far more efficient indirect heat exchanger than has heretofore been possible. In addition, the method of constructing the heat exchangers from a plurality of identical core sections 4, each of which is of a relatively simple construction, amenable to being cast or otherwise mass produced, makes it possible to mass produce the heat exchangers 2. Former processes for producing such heat exchangers usually require customized, individual construction of single units. It can thus be seen that the apparatus and the particular construction of heat exchanger disclosed herein are susceptible of wider variants than disclosed in this particular preferred embodiment of the invention, and include, in addition to the preferred embodiments disclosed herein, those equivalents as are implied in the claims which follow.

Figure 8:
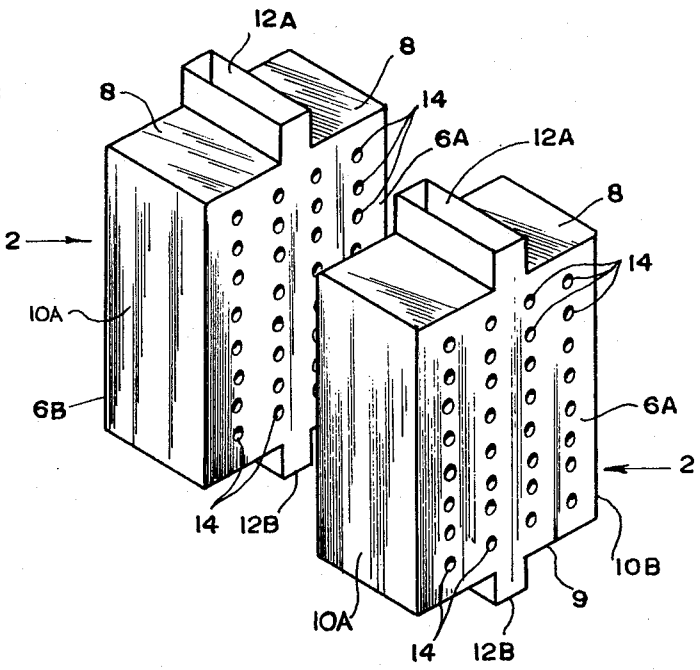
FIG. 8 is a perspective view of a heat exchanger for transferring heat energy between three separate fluids.

The heat exchanger can also be used in a system in which heat energy is exchanged between more than two fluids. For example, as shown in FIG. 8, two heat exchangers 2 can be used to allow heat to be transferred between three separate fluids. A first fluid (which may comprise a gas) would flow through the first heat exchanger 2, entering and exiting the first heat exchanger via flow entrances 12A and 12B, respectively. A second fluid (which may also comprise a gas) would flow through the second heat exchanger, entering and exiting the second heat exchanger via flow entrances 12A and 12B, respectively, of the second heat exchanger. A third fluid would flow through convoluted passages 14 of the first and second heat exchangers.

I claim:

1. An improved heat exchanger comprising:

an enclosed, fluid tight flow chamber having an entry port and an exit port, and a first face and a second face, for passing a first fluid from said entry port through said fluid chamber to said exit port;

a plurality of fluid tight convoluted passages extending from said first face to said second face, for providing a plurality of flow paths for a second fluid through said chamber containing said first fluid, such that said first and second fluids are maintained separate from each other;

said flow chamber and said convoluted passages being formed as a unitized seamless shell.

2. The heat exchanger of claim 1, wherein said flow passages further comprise a uniform array of repeating reversibly angled flow passages.

3. The heat exchanger of claim 1, wherein at least one of said first fluid or said second fluid are gases.

4. A heat exchanger for transferring heat energy between three separate fluids comprising:

first and second enclosed fluid tight flow chambers, each having an entry port, an exit port, a first face and a second face, said first flow chamber for passing a first fluid from said entry port of said first chamber, through said first chamber, to said exit port of said first chamber, said second flow chamber for passing a second fluid from said entry port of said second chamber, through said second chamber, to said exit port of said second chamber;

a plurality of fluid tight convoluted passages in each of said first and second chambers extending from said first face to said second face, for providing a plurality of flow paths for a third fluid through said first and second chambers containing said first fluid and said second fluid, respectively, such that said first, second and third fluids are maintained separately from each other; and the first flow chamber and the convoluted passages therein being formed as a unitized seamless shell and the second flow chamber and the convoluted passages therein being formed as a unitized seamless shell.

5. The heat exchanger of claim 4, wherein said flow passages further comprise a uniform array of repeating reversibly angled flow passages.

6. The heat exchanger of claim 4, wherein at least one of said first fluid or said second fluid is a gas.

* * * * *